US011686182B2

(12) United States Patent
Trine et al.

(10) Patent No.: US 11,686,182 B2
(45) Date of Patent: Jun. 27, 2023

(54) TOP-DOWN CEMENTING OF LINER ASSEMBLY

(71) Applicant: WEATHERFORD TECHNOLOGY HOLDINGS, LLC, Houston, TX (US)

(72) Inventors: Zachary S. Trine, Houston, TX (US); Nicholas W. McFarlin, Odessa, TX (US); Eric R. Evans, Magnolia, TX (US); Joshua V. Symms, Cypress, TX (US)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 0 days.

(21) Appl. No.: 17/504,665

(22) Filed: Oct. 19, 2021

(65) Prior Publication Data

US 2023/0119630 A1 Apr. 20, 2023

(51) Int. Cl.
*E21B 43/10* (2006.01)
*E21B 33/16* (2006.01)

(52) U.S. Cl.
CPC ..... *E21B 43/10* (2013.01); *E21B 33/165* (2020.05); *E21B 2200/06* (2020.05)

(58) Field of Classification Search
CPC ..... E21B 43/10; E21B 33/165; E21B 2200/06
See application file for complete search history.

(56) References Cited

U.S. PATENT DOCUMENTS 5,348,089 A * 9/1994 Brandell ..... E21B 34/14 166/291
7,225,870 B2 * 6/2007 Pedersen ..... E21B 23/01 166/134
10,246,968 B2 * 4/2019 Budde ..... E21B 33/16
10,633,949 B2 4/2020 Tilley et al.
10,655,428 B2 5/2020 Giroux et al.
2010/0155067 A1 * 6/2010 Tunget ..... E21B 33/138 175/320
2013/0299169 A1 * 11/2013 Rex ..... E21B 43/108 166/285
2015/0176367 A1 * 6/2015 Hern ..... E21B 34/14 166/285

(Continued)

OTHER PUBLICATIONS

Weatherford. "HNG Hydraulic-Release Running Tool." Liner Systems. 2006. 1 page.

(Continued)

*Primary Examiner* — Taras P Bemko
(74) *Attorney, Agent, or Firm* — Cabello Hall Zinda, PLLC

(57) ABSTRACT

A running tool sets and cements a liner in a borehole. While the tool's bypass section is closed, a plug deployed to the tool diverts hydraulic pressure to set a liner hanger in the borehole. The setting plug is unseated, and the bypass section is switched opened by deploying another plug to an opening seat and shifting a control sleeve open relative to a bypass port. While the tool's packoff remains sealed in the hanger, cement pumped out the bypass port is bullheaded into a lap of the liner and borehole. When cementing is complete, the bypass section is switched closed by deploying another plug to a closing seat and shifting the control sleeve closed relative to the bypass port. The bypass section is then placed in a flow-through condition where fluid communication is reestablished through the tool to the liner by allowing fluid to flow past the plugs in the tool.

24 Claims, 10 Drawing Sheets

(56) References Cited

U.S. PATENT DOCUMENTS

| | | | | |
|---|---|---|---|---|
| 2019/0106964 | A1 | 4/2019 | Strohla et al. | |
| 2021/0115757 | A1 | 4/2021 | Murray et al. | |
| 2021/0189835 | A1* | 6/2021 | Maddux | E21B 33/16 |

OTHER PUBLICATIONS

Weatherford. "IntegraLine High-Performance Liner System with Swage Technology." 2015. 14 pages.
Weatherford. "WRPA Rotating Packer Actuator." Liner System. 2010. 2 pages.
Weatherford. "Xpress Liner System." Liner Systems, Tech Specs. 2019, 2 pages.

* cited by examiner

TOP-DOWN CEMENTING OF LINER ASSEMBLY

BACKGROUND OF THE DISCLOSURE

The subject matter for the present disclosure is directed to a system and a method to perform a top-down cementing operation on a liner assembly.

BACKGROUND OF THE DISCLOSURE

For a traditional cemented liner installation in a horizontal well, cement is pumped down a running string, through a liner, and into the annulus around the backside of the liner in order to cement the liner in place. By contrast, operators may perform a top-down cement operation during some types of liner installations. The top-down cement operation is historically performed by closing-off the liner and unstinging the running tool from the liner to circulate cement into the annulus down the backside of the liner from the uphole end of the liner assembly.

For example, a conventional top-down cement operation can involve blocking-off the shoe track with a wiper plug, un-stinging the running tool from the liner, and pumping cement down the backside annulus of the liner from the rig floor. However, performing this operation while maintaining a wet shoe track and while keeping cement from being left inside the liner after operation can be challenging. For this reason, a wet shoe typically cannot be obtained in a top-down cement operation, and cement can be left inside the liner, which is not ideal.

The subject matter of the present disclosure is directed to overcoming, or at least reducing the effects of, one or more of the problems set forth above.

SUMMARY OF THE DISCLOSURE

A running tool is disclosed herein for setting and cementing a liner assembly in a borehole using a plurality of plugs and cementation. The liner assembly has a liner bore. The running tool comprises a tool body and a bypass section. The tool body has a tool bore extending therethrough. The bypass section of the of the tool body defines a bypass port for the cementation. The bypass port communicates the tool bore outside the tool body.

The bypass section at least includes: a control sleeve, an opening seat, and a closing seat. The control sleeve has a control port and being movable in the tool bore relative to the bypass port. The opening seat is configured to engage a first of the plugs and is movable in the tool bore, and the closing seat is configured to engage a second of the plugs and is movable in the tool bore. The bypass section in a closed condition is configured to prevent fluid communication from the tool bore out the bypass port. The bypass section in an opened condition is configured to open fluid communication from the tool bore out the bypass port in response to a first of the plugs engaged in the opening seat. The bypass section in a flow-through condition is configured to close fluid communication from the tool bore out the bypass port in response to a second of the plugs engaged in the closing seat and is configured to communicate flow through the tool bore past the first plug, the opening seat, the second plug, and the closing seat in the tool bore.

A running tool is disclosed for setting and cementing a liner assembly in a borehole with cementation. The liner assembly has a liner bore. The running tool comprises a tool body and a bypass section. The tool body is at least partially insertable in the liner bore and has a tool bore extending therethrough. The bypass section of the of the tool body defines a bypass port for the cementation. The bypass port communicates the tool bore outside the tool body. The bypass section at least includes: a control sleeve, and opening seat, and a closing seat. The control sleeve has a control port and being movable in the tool bore relative to the bypass port. The control sleeve in a closed position is configured to prevent fluid communication between the control port and the bypass port. The control sleeve in an opened position is configured to permit fluid communication between the control port and the bypass port. The opening seat is movable in the tool bore. The opening seat in a first position is configured to prevent fluid communication through the control port, and the opening seat in a second position is configured to permit fluid communication through the control port. The closing seat is movable in the tool bore. The closing seat in a third position is configured to prevent movement of the control sleeve from the closed position to the opened position, and the closing seat in a fourth position is configured to permit movement of the control sleeve from the closed position to the opened position.

A system is disclosed for setting in a borehole using a running string. The borehole has a cased section. The system comprises a liner and a running tool as disclosed above. The liner has a liner hanger, which has a setting mechanism and a hydraulic actuator. The hydraulic actuator has an actuator port in a liner bore of the liner hanger, and the hydraulic actuator is configured to set the setting mechanism in the cased section of the borehole. The running tool is configured to connect to the running string and is at least partially insertable in the liner bore.

A method of lining a borehole with a liner is disclosed. The borehole has a cased section. The method comprises: running the liner in the borehole using a running tool; setting a liner hanger on the liner in the cased section using hydraulic pressure from the running string; opening a bypass port on the running tool uphole of a packoff of the running tool in the liner hanger using hydraulic pressure from the running string behind an opening plug seated in the running tool; bullheading cement into a lap of the liner and the borehole through the bypass port; closing the bypass port on the running tool using hydraulic pressure from the running string behind a closing plug seated in the running tool; and reestablishing fluid communication from the running string to the liner through the running tool past the opening and closing plugs.

The foregoing summary is not intended to summarize each potential embodiment or every aspect of the present disclosure.

DETAILED DESCRIPTION OF THE DISCLOSURE

Figure 1:
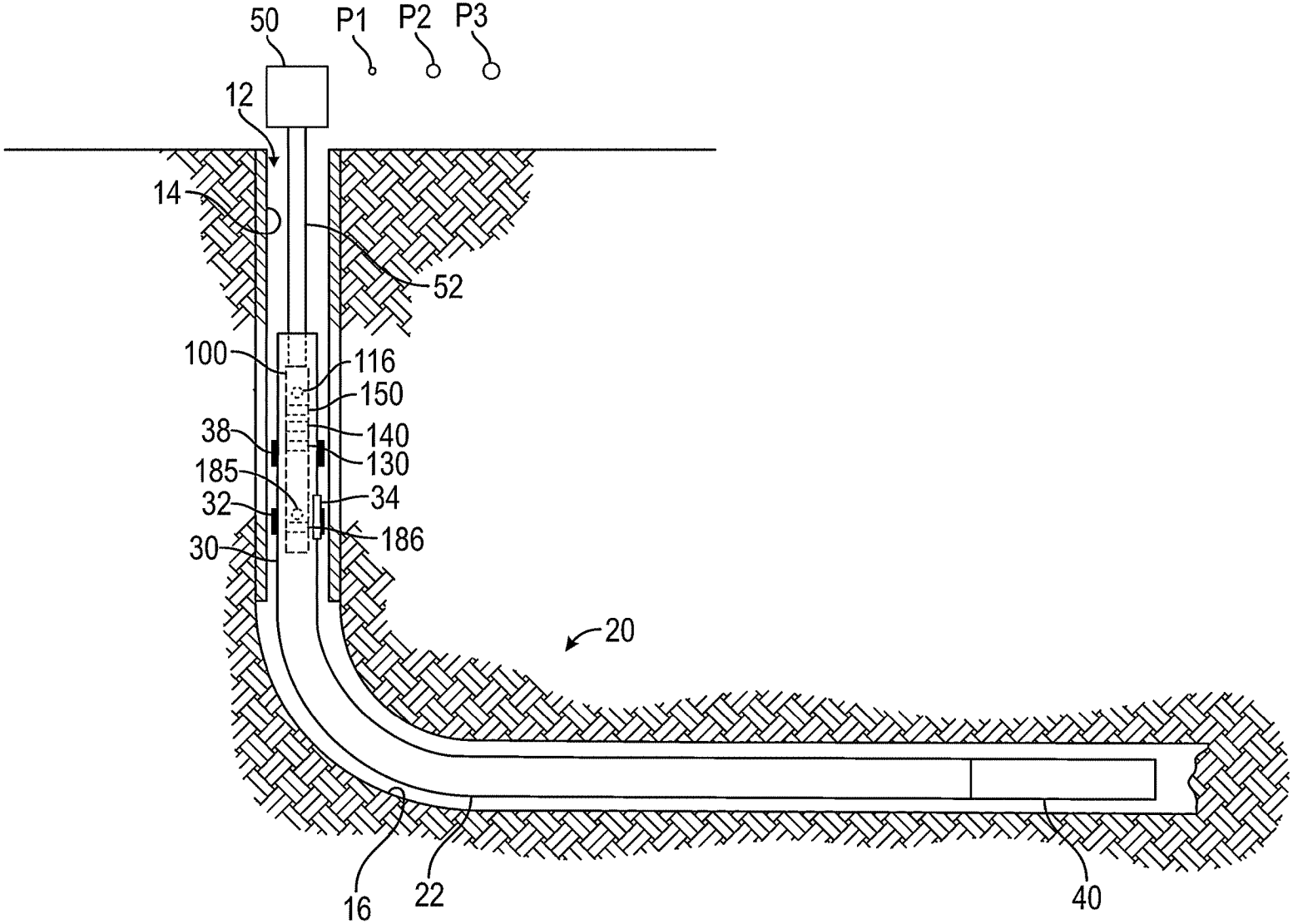
FIG. 1 schematically illustrates a system of the present disclosure for completing a borehole.

FIG. 1 schematically illustrates a system 10 of the present disclosure for completing a borehole 12. The system 10 includes a liner assembly 20 and a running tool 100. In general, the running tool 100 is used for setting and top-down cementing of the liner assembly 20 in the borehole 12. For its part, the liner assembly 20 includes a liner 22 to be supported in the borehole 12 with a liner hanger system 30. The toe of the liner 22 can have a shoe track 40.

The liner hanger system 30 has a setting mechanism 32, such as slips, for setting in a cased section 14 of the borehole 12 using a hydraulic mechanism 36. When the setting mechanism 32 is set, the liner hanger system 30 supports the liner 22 and shoe track 40, which can typically extend into an open section 16 of the borehole 12. A packer 38 on the liner hanger system 30 can be used to create an annular seal.

To run in, set, and cement the liner assembly 20, operators at surface use the setting tool 100, which deploys the liner assembly 20 from surface equipment 50 using a running string 52. As only schematically shown in FIG. 1 (but detailed below), the running tool 100 installs at least partially in the liner hanger system 30 and includes a bypass port 116, an opening unit 130, a control unit 140, a closing unit 150, a setting port 185, and a setting seat 186.

Having a general overview of the system 10, some of the steps involved in running, setting, and top-down cementing of the liner assembly 20 in the borehole 12 using the running tool 100 according to the present disclosure will be briefly described. A number of conventional steps may be omitted from this description, but would be appreciated by one skilled in the art.

At surface, the liner assembly 20 is assembled with the shoe track 40, the liner 22, the liner hanger system 30, and a polished bore receptacle (not labelled). The running tool 100 is made up and installed in the liner assembly 20. Then, the running tool 100 is run downhole from the surface equipment 50 on the running string 52 to run the liner assembly 20 in the borehole 12. Fluid communication down the running tool 100 can pass out the shoe track 40 of the liner assembly 20 during run-in. The fluid circulated out of the shoe track 40 assists with the run-in hole operations and setting of the liner assembly 20. The running tool 100 may allow for rotation of the liner 22 during run in to facilitate installation.

At setting depth, the liner hanger system 30 on the liner assembly 20 is set in the cased section 14 of the borehole 12 using hydraulic pressure from the running string 52. To do this, a setting plug P1 is deployed down the running string 52 from the surface equipment 50 to the running tool 100. Reaching the tool 100, the setting plug P1 engages the setting seat 186 of the tool 100. Hydraulic pressure out of the setting port 185 on the tool 100 then actuates the hydraulic mechanism 34 (e.g., piston) on the liner hanger system 30 to set the setting mechanism 32 (e.g., slips) in the cased section 14. For example, a hydraulic piston 34 can engage slips 32 on the liner hanger system 30 against the cased section 14. The setting plug P1 is then passed through the seat 186 in response to a predetermined amount of the hydraulic pressure. Circulated fluid out the shoe track 40 can then perform open hole conditioning.

After setting the setting mechanism 32 in the cased section 14 so the liner hanger system 30 can support the liner 22, cementing operations can then be performed. As noted, a traditional cemented liner installation in a horizontal well involves pumping cement down a running string, through a liner, and into the annulus around the backside of the liner in order to cement the liner in place. The present system 10 is instead used for top-down cementing.

For example, in some installations, placing cement around the liner 22 in the open horizontal section 16 of the borehole 12 may not be necessary because the horizontal section 16 is to be left as an open hole. However, there may be a desire in the particular implementation to place cement around the top of the liner 22 in the vertical section of the borehole 10. To do this, cement is pumped down the running string 52 and into the annulus between the liner 22 and the parent casing 14 without needing to pump the required volume of cement through the entire liner 22 itself. Performing the installation in this manner can save a significant amount of time and money for the cementing operation of the liner installation.

To perform the top-down cementing, an opening plug P2 is deployed from the surface equipment 50 through the running string 52 to seat in the opening unit 130 in the running tool 100. The bypass port 116 on the running tool 100 is then opened using hydraulic pressure from the running string 52 behind the opening plug P2 seated in the opening unit 130. This bypass port 116 is uphole of a packoff (e.g., 170 in FIG. 3) of the running tool 100 in the liner hanger system 30. Cement is bullheaded down the running string 52, out the bypass port 116, and into a lap between the liner 22 and the borehole 12.

For instance, while running the liner 22 in the hole, the bypass port 116 is in a closed position, allowing for full circulation out the liner's shoe track 40. The opening plug P2, such as a ball, dart, or other plug, can be free-fall dropped/pumped from the surface equipment 50 and landed into the opening unit 130, opening the bypass port 116 and closing off access beyond the tool 100 itself (to the liner 22 below). Top down squeeze cementing operations are then performed through the now open bypass port 116.

In the liner top squeeze operation, the cement is circulated down the running string 52 and out the bypass ports 116, while annular rams at the surface equipment 50 are closed so the cement is bullheaded into the annulus across the liner lap. In general, the liner lap can include about 500 feet or so of overlap of the liner 22 with the cased section 14 of the borehole 12.

Once cementing is completed, a closing plug P3, such as a ball, a dart, or other plug, is pumped from the surface equipment 50 through the running string 52 to displace the cement outside the running tool 100. The closing plug P3 then seats in the closing unit 150 in the running tool 100. Hydraulic pressure from the running string 52 behind the seated closing plug P3 in the closing unit 150 then allows the control unit 140 of the running tool 100 to close relative to the bypass port 116 to prevent fluid communication out of the running tool 100. For example, the closing plug P3 seated inside the running tool 100 can shift the control unit 140 into a closed and permanently locked position relative to the bypass port 116.

Also, the closing of the control unit 140 can allow the closing plug P3, the closing unit 150, the opening plug P2, and the opening unit 130 to shift into a specified location or condition that allows for circulation to be regained below the running tool 100 and through the liner's shoe track 40. For example, the closing plug P3, the closing unit 150, the opening plug P2, and the opening unit 130 can either be retained just below the control unit 140 in a specified location that allows fluid to be bypassed below, or these internal components (P3, 150, P2, 130) can be pumped further down through the liner system 20 to a fluted joint (not shown) in the liner 22 to allow fluid to bypass. Preferably, the internal components (P3, 150, P2, 130) do not free fall to the bottom of the liner assembly 20, but they are caught within a bypass area so that flow can be established around the components (P3, 150, P2, 130).

In the end, fluid communication from the running string 52 to the liner 22 is reestablished through the running tool 100 past the components (P3, 150, P2, 130), which remain in the tool 100 while fluid communication is closed off at the bypass port 116 where the cement was placed. The reestablished fluid communication through the running tool 100 with the bypass port 116 closed allows pressure testing of the liner assembly 20 to be performed after the cement job is completed. Also, after the cement job is completed, it is desired to regain the ability to pump-out the shoe track 40 to ensure there is a wet shoe so first stage injection can be performed in later completion operations. Additional cleaning of the cement operations above the liner assembly 20 may be performed if necessary. Advantageously, the system 10 avoids placement of cement inside the liner assembly 20 so that a clean out operation is not needed, which is additional cost on the production string.

Figure 2:
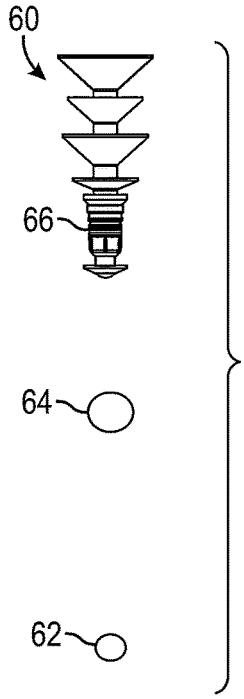
FIG. 2 illustrates a set of plugs used in the disclosed system.
Figure 3:
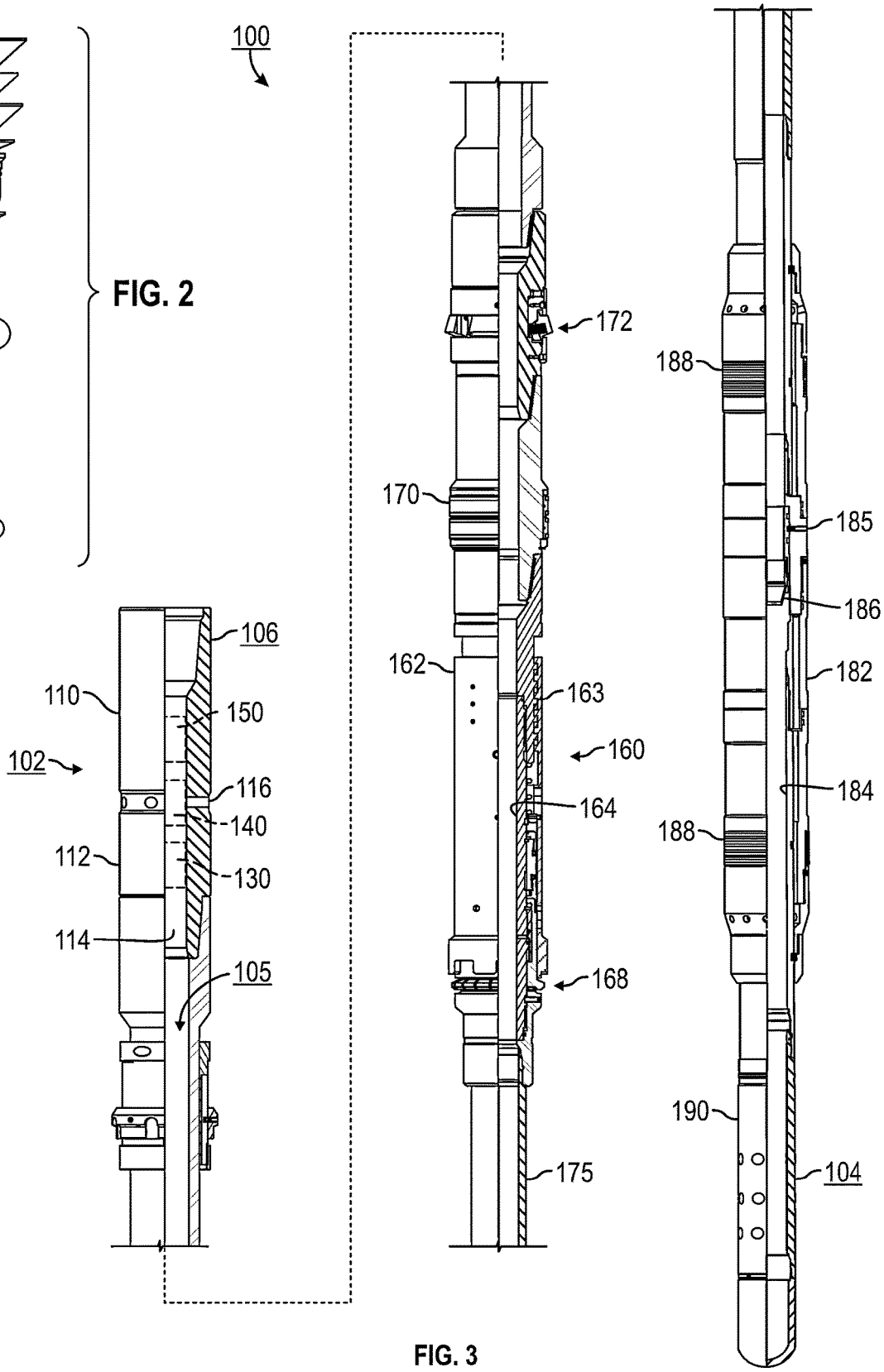
FIG. 3 illustrates a partial cross-section of a running tool for the disclosed system.
Figure 4:
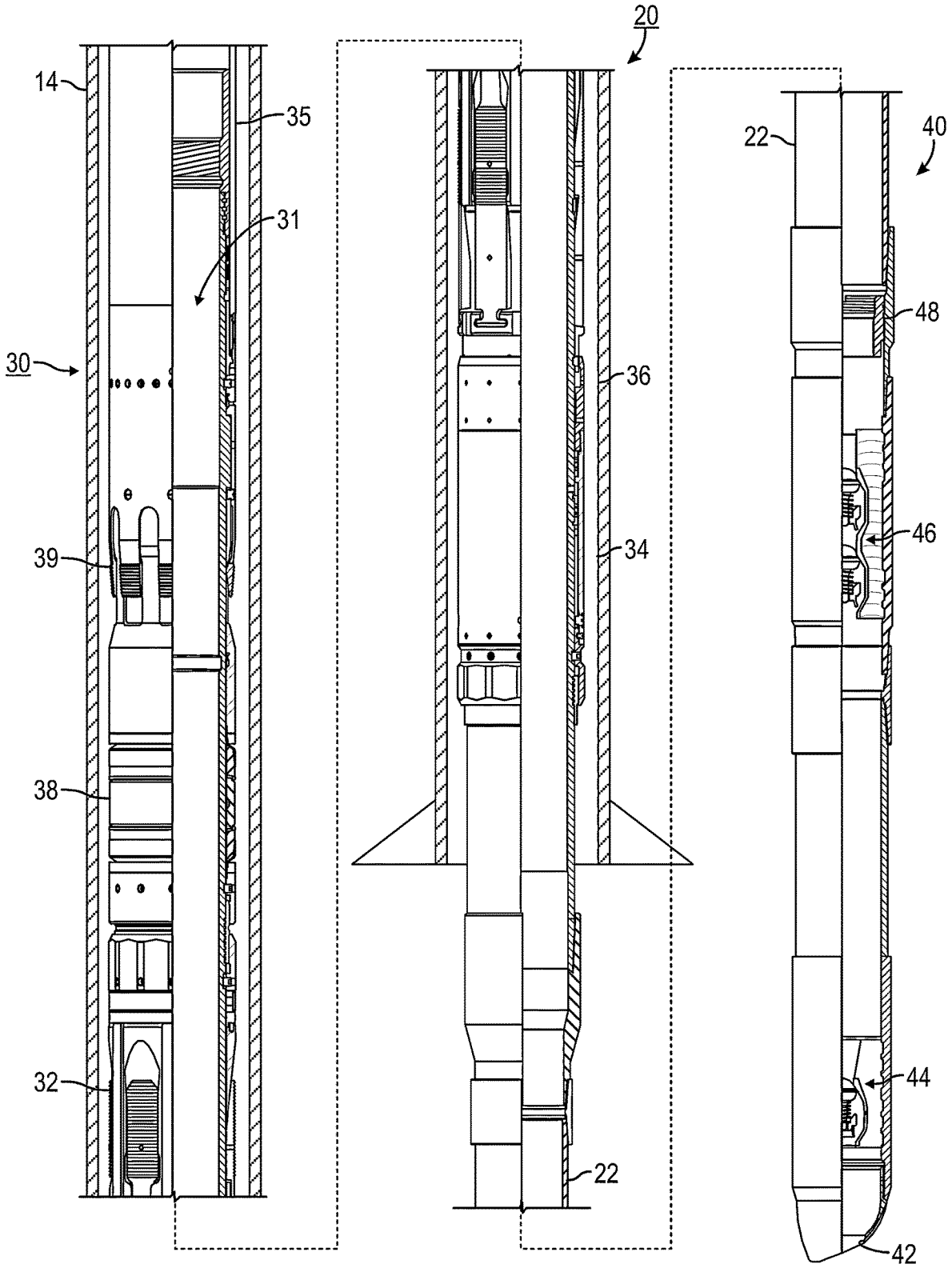
FIG. 4 illustrates a partial cross-section of a liner assembly for the disclosed system.

Discussion now turns to FIGS. 2-4 to describe a configuration of the disclosed system 10 in more detail. FIG. 2 illustrates a set of plugs 60 that can be used in the disclosed system (10). The plugs 60 include a setting plug 62, an opening plug 64, and a closing plug 66. As shown, the setting plug 62 can be a ball deployable down the running string (52) for engaging a seat inside the running tool (100), as disclosed herein. As also shown, the opening plug 64 can be a larger ball deployable down the running string (52) for engaging a seat inside the running tool (100), as disclosed herein. Finally, as shown, the closing plug 66 can be a dart deployable down the running string (52) for engaging a seat inside the running tool (100), as disclosed herein. Wipers on the closing plug 66 can wipe the running string (52) of cement and can separate the preceding cement from the displacement fluid that follows. Although balls and darts are shown for the plugs 60, other types of plugs can be used depending on the implementation.

FIG. 3 illustrates a running tool 100 of the disclosed system 10 in partial cross-section, and FIG. 4 illustrates a liner assembly 20 for use in the disclosed system in partial cross-section. As noted above, the running tool 100 in FIG. 3 connected to the running string (52) is used to run and set the liner assembly 20 of FIG. 4 downhole in a borehole. The running tool 100 is then used to perform top-down cementing and then set a compression-set packer 38 of the liner assembly 20.

For its part, the liner assembly 20 can include a number of conventional features. As shown in FIG. 4, the liner assembly 20 includes a liner hanger system 30 from which a liner 22 extends downhole. A polished bore receptacle 35 is attached atop the liner hanger system 30 and extends uphole. The distal end of the liner 22 has a shoe track 40, which can include a float shoe 44, a float collar 46, and a landing collar 48. The float shoe 44 and collar 46 include valves to allow fluid flow out a toe port 42 of the track 40, but prevent reverse flow into the track 40. Other configurations are possible.

In general, the liner hanger system 30 has a setting mechanism 32 and a hydraulic actuator 34. The hydraulic actuator 34 has an actuator port 36 in a bore 31 of the liner hanger system 30, and the hydraulic actuator 34 is configured to set the setting mechanism 32 in the borehole. As specifically shown, the hydraulic actuator 34 can be a hydraulic piston, and the setting mechanism 32 can include slips. The hydraulic piston 34 communicates through the actuator port 36 with the bore 31 of the liner hanger's housing. Moved by hydraulic pressure, the piston 34 pushes the slips 32 against setting cones on the hanger 30 to engage the slips 32 inside the cased section 14 of the borehole when setting downhole.

As further shown, the liner assembly 20 includes a liner top packer 38 connected uphole of the liner hanger system 30. The liner top packer 38 is configured to set by compression in the cased section 14 of the borehole. Additional slips 39 uphole of the packer 38 can engage the cased section 14 to hold the packer 38 in a compressed state. Finally, the polished bore receptacle 35 is connected to the liner top packer 38.

As shown in FIG. 3, the running tool 100 includes a tool body 102 having a downhole end 104, an uphole end 106, and a tool bore 105 therethrough. In general, the tool body 102 can be made up of several interconnected sections, assemblies, tools, or components 110, 160, 180 so that the tool bore 105 extends through the running tool 100. The uphole end 106 of the running tool 100 is configured to connect to the running string (52), and the tool body 102 installs in the liner bore (31) to run and set the liner assembly (20).

As shown in FIG. 3, an isolation section or pressure isolation assembly 180 of the tool body 102 is disposed toward the downhole end 104 of the running tool 100. The pressure isolation assembly 180 has a pressure port 185 and a setting seat 186. The pressure port 185 communicates with the tool bore 105, and the setting seat 186, which has a slidable sleeve, is movable in the tool bore 105 from a first closed position to a first opened condition relative to the pressure port 185. The isolation section 180 is configured to seal in a portion of the liner hanger's bore (31) with the pressure port 185 in communication with the actuator port (36). For example, the pressure isolation assembly 180 includes packoff seals 188 disposed thereabout uphole and downhole of the pressure port 185. These packoff seals 188 are configured to seal in the portion of the liner bore (31) uphole and downhole of the actuation port (36) so fluid from the pressure port 185 can be communicated to the actuator port (36) used to move the hanger's piston (34) and set the slips (32).

A setting section or hydraulic running assembly 160 of the of the tool body 102 is disposed uphole of the isolation section 180 and has an engagement mechanism 168, which is configured to engage in the liner bore (31) of the liner hanger system (30) for running-in the liner (22). For example, the engagement mechanism 168 can include conventional components for running a liner hanger. As shown here, the engagement mechanism 168 can include a supported collet that bears the weight of the liner assembly (20). Castellations on a torque sleeve of the mechanism 168 can mate with castellations on the liner-top packer or liner setting sleeve to allow the mechanism 168 to rotate the liner assembly (20) during run-in. A primary release of the mechanism 168 is activated when differential pressure across a hydraulic cylinder retracts the collet from the liner-top packer or liner setting sleeve. For example, after setting the liner hanger system (30) and before passing the setting P1 through the seat 186, additional hydraulic pressure is applied to activate the setting section 160 and release the engagement mechanism 168 from engagement with the liner hanger system 30. The mechanism 168 can also have a secondary release that is activated with a partial left-hand turn at the rotatable connection 163, which moves the tool 100 into compression and allows the mechanism 168 to retract.

The hydraulic running assembly 160 also include a pack-off 170 for sealing in the polished bore receptacle (35) of the liner assembly (20). Additionally, the setting section 160 includes a packer actuator 172, which can include conventional components for compression setting the packer (38) of the liner assembly (20) in a conventional manner. For example, the packer actuator 172 can have spring-loaded dogs, which are collapsed inside the polished bore receptacle (35) during run-in. To set the liner assembly's packer (38) after cementing, the running tool 100 is picked up from liner hanger system (30) until the dogs of the actuator 172 are placed out of the liner top (not shown). When exposed above the polished bore receptacle (35), the dogs are forced outward and cannot re-enter the receptacle (35). Weight set down on the running string (52) at this point transfers to the receptacle (35) through the packer actuator 172 to compress the packer (38) and to set the packer slips (39) as the hanger's set slips (32) hold the hanger (32) in place. A bearing in the packer actuator 172 can enable rotation of the running string (52) to help transfer weight downward to set the liner-top packer (38) during this process.

Finally, a bypass section or top-down cementing assembly 110 of the tool body 102 is disposed toward the uphole end 106, where the running tool 100 can attach to the running string 52. The top-down cementing assembly 110 has the bypass port 116, the opening unit 130, the control unit 140, and the closing unit 150, as briefly discussed above.

The disclosed system 10 and method can reduce the risk of leaving cement inside the liner assembly 20 without the need for additional equipment to be run above the running tool 100. During cementing operations with the running tool 100 and the liner assembly 20 of the present disclosure, for example, it is not necessary to pump primary cement into the liner annulus prior to performing liner top squeeze operations with this configuration. Also, a landing plug is not required at the shoe track 40 to have a sealed tubing string. Instead, the opening ball 62 retained within the running tool 100 acts as a pressure seal while performing squeeze operations when the tool 100 is in the open position. Likewise, float equipment may not be required if the liner assembly 20 is a production string. This means that less drill out may be required because the shoe track 40 does not need to be drilled out.

Having an understanding of the components of the liner assembly 20 and the running tool 100, discussion now turns to FIGS. 5 through 8, which illustrate operation of the top-down cementing assembly 110 in further detail.

Figure 5A:
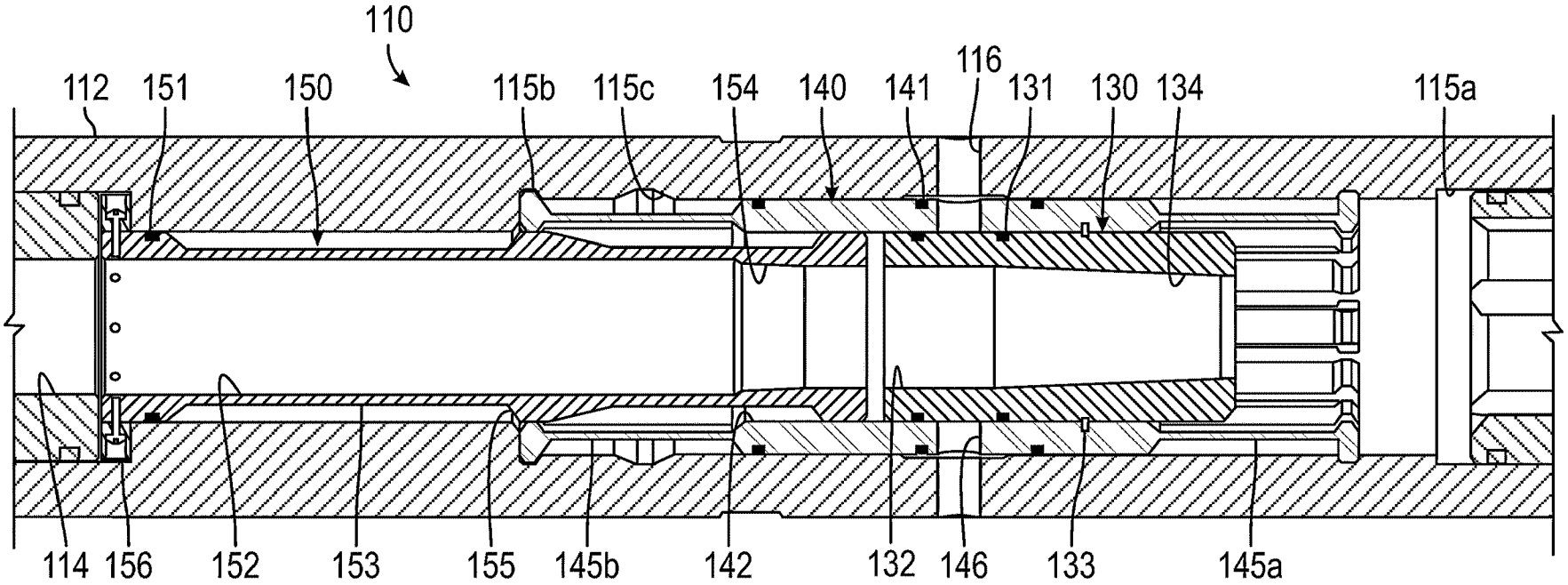
FIGS. 5A-5B illustrate cross-sections of a top-down cementing assembly for the running tool during initial stages of operation.
Figure 5B:
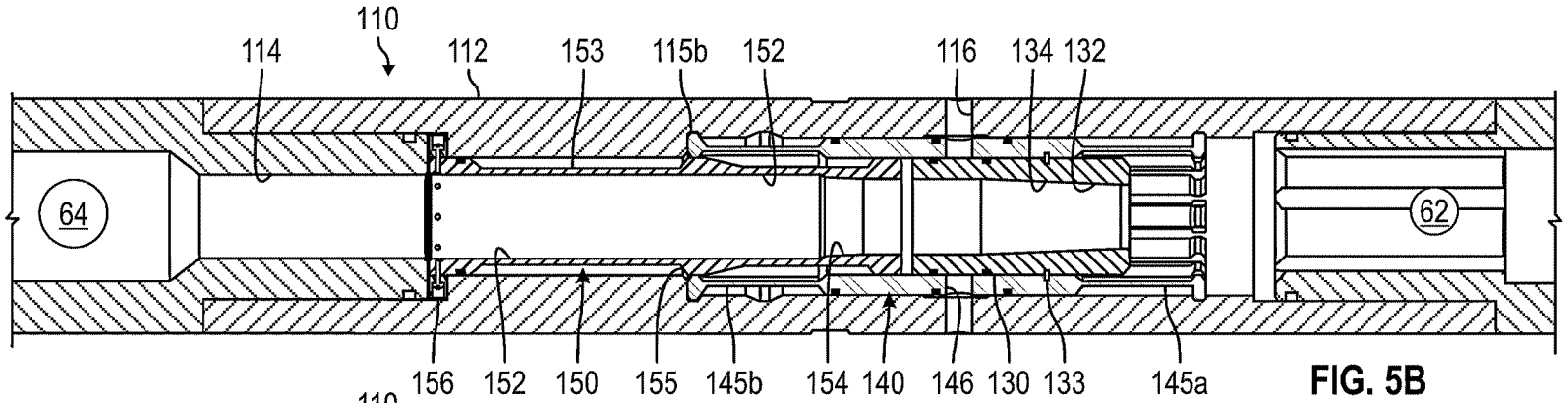

FIGS. 5A-5B illustrate the top-down cementing assembly 110 of the running tool 100 in cross-section during initial stages of operation. As shown, the cementing assembly 110 includes a housing 112, which can be comprised of one or more components as is typical. The housing 112 has a housing bore 114 passing therethrough (as part of the tool bore 105). The bypass port 116 communicates with the housing bore 114.

The control unit 140 is a control sleeve disposed in the housing bore 114. The control sleeve 140 has a control port 146, which can be aligned or misaligned with the bypass port 116. Seals 141 on the control sleeve 140 can seal inside the housing's bore 114.

The opening unit 130 is an opening sleeve disposed at least partially in the bore 142 of the control sleeve 140. The opening sleeve 130 has a seat 134 in the sleeve's bore 132, and the opening sleeve 130 is movable in the control sleeve 140 from a closed condition to an opened condition relative to the control port 146. Seals 131 on the opening sleeve 130 can seal inside the control sleeve's bore 142.

The closing unit 150 is a closing sleeve disposed at least partially in the control sleeve 140. The closing sleeve 150 has a seat 154 in the sleeve's bore 152, and the closing sleeve 150 is movable in the control sleeve 140. A seal 151 on the closing sleeve 140 can seal inside the housing's bore 114.

The top-down cementing assembly 110 is shown in FIGS. 5A-5B with the opening sleeve 130, the control sleeve 140, and the closing sleeve 150 in their run-in positions. The control sleeve 140 is in an opened position with the control port 146 aligned with the tool's bypass port 116. External seals 141 on the control sleeve 140 can seal inside the housing's bore 114 to seal off the bypass port 116. The opening sleeve 130 disposed in the bore 142 of the control sleeve 140 is in a closed position, preventing fluid communication through the control and bypass ports 146, 116. A temporary connection 133, such as shear pins, or the like can be used between the opening sleeve 130 and the control sleeve 140 to hold the opening sleeve 130 in place until released, as discussed below.

The closing sleeve 150 is held in an initial condition in the housing's bore 114 using a temporary connection 156, such as shear pins or the like. Part of the closing sleeve 150 fits into the control sleeve 140 so that portion 155 of the closing sleeve 150 engages a catch 145*b* of the control sleeve 140 to hold the control sleeve 140 in place. For example, an external rim 155 on the closing sleeve 150 holds fingers of an upper collet 145*b* on the control sleeve 140 engaged with an upper profile 115*b* inside the section's bore 114. This holds the control sleeve 140 in the opened condition so its ports 146 are aligned with the bypass ports 116. Another catch 145*a* on the control sleeve 140 can be contracted in the housing's bore 114. For example, fingers of a lower collet 145*a* of the control sleeve 140 can be engaged inside the section's bore 114 to hold the control sleeve 140 in place.

Figure 6A:
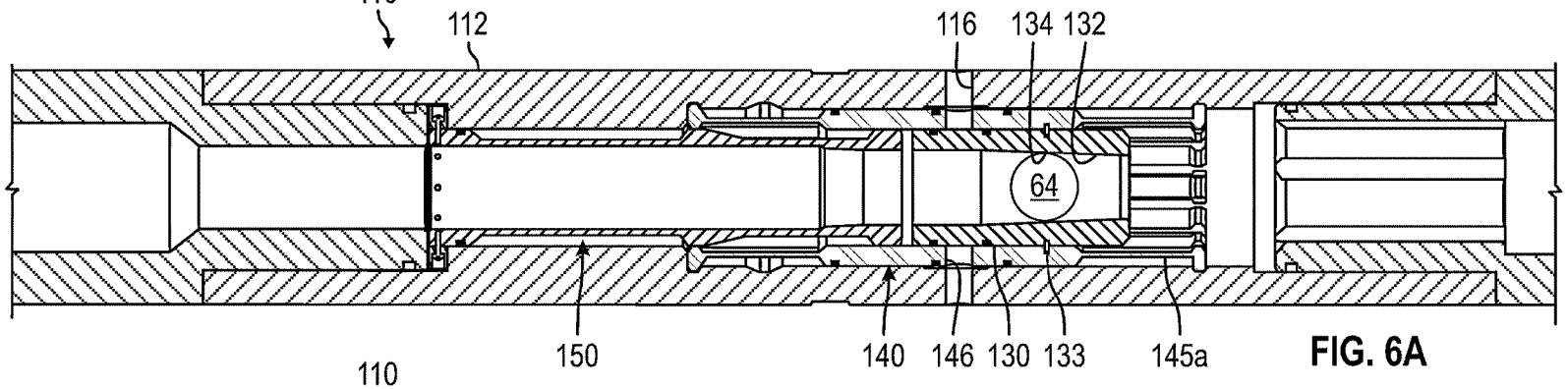
FIGS. 6A-6B illustrate cross-sections of the top-down cementing assembly during opening stages of operation.

As noted above, operations begin by deploying the setting plug 62 down the running tool (100). As shown in FIG. 6A, the setting plug 62 is sized to pass through the seat 134 of the opening sleeve 130 and the seat 154 of the closing sleeve 150. Once the setting steps are complete as noted above, the running tool (100) can remain in place in the liner hanger system (30) so that the bypass port 116 can communicate with the liner lap for top-down cementing.

Figure 6B:
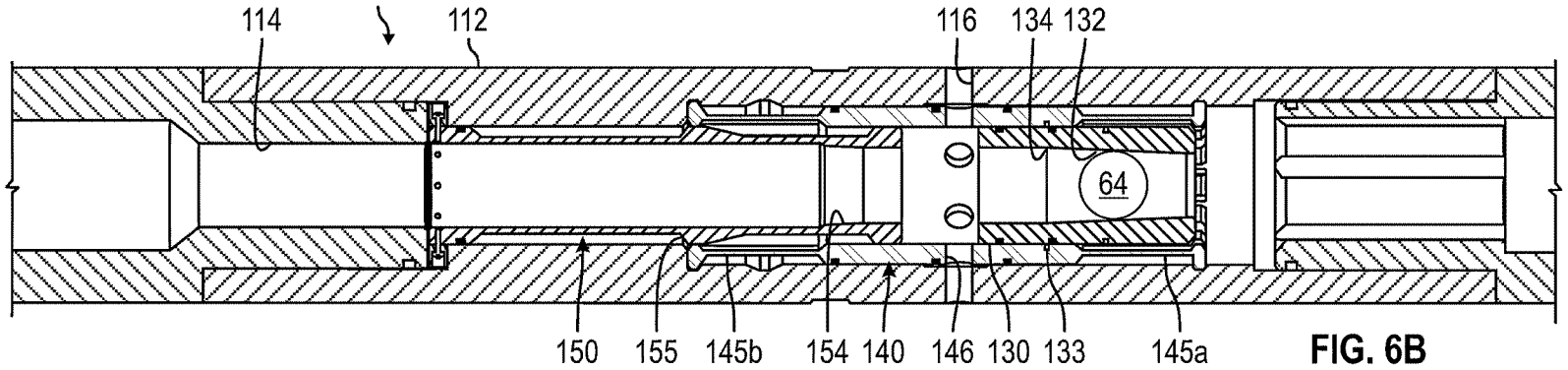

As shown in FIG. 6A, the opening plug 64 is then deployed down the running tool (100). As shown in FIGS. 6B-6C, the opening plug 64 seats in the seat 134 of the opening sleeve 130, and hydraulic pressure communicated through the bore 114 shifts the opening sleeve 130 in the control sleeve 140 open relative to the control ports 146 by shearing the connection 133. The opening sleeve 130 is eventually caught by the lower collet 145*a* of the control sleeve 140 contracted in the housing bore 114. Movement of the opening sleeve 130 to the opened condition relative to the control port 146 allows for fluid communication from the housing's bore 114, through the control port 146, and out the aligned bypass port 116 to commence cementing operation as discussed herein. Fluid communication can now be diverted out of the control and bypass ports 146 and 116 so the cement can communicate with the liner lap for top-down cementing.

Meanwhile, the closing sleeve 150 is still engaged with the control sleeve 140 through the external rim 155 engaged with the collet 145*b*. The closing sleeve 150 is configured to release the control sleeve 140 when activated. To end cementing operations as discussed below, the control sleeve 140 is releasable in the housing's bore 114 to move the control port 146 closed relative to the bypass port 116. Ultimately, fluid communication through the running tool's bore can be reestablished so further completion operations can be performed as also discussed below.

Figures 7A, 7B, 7C:
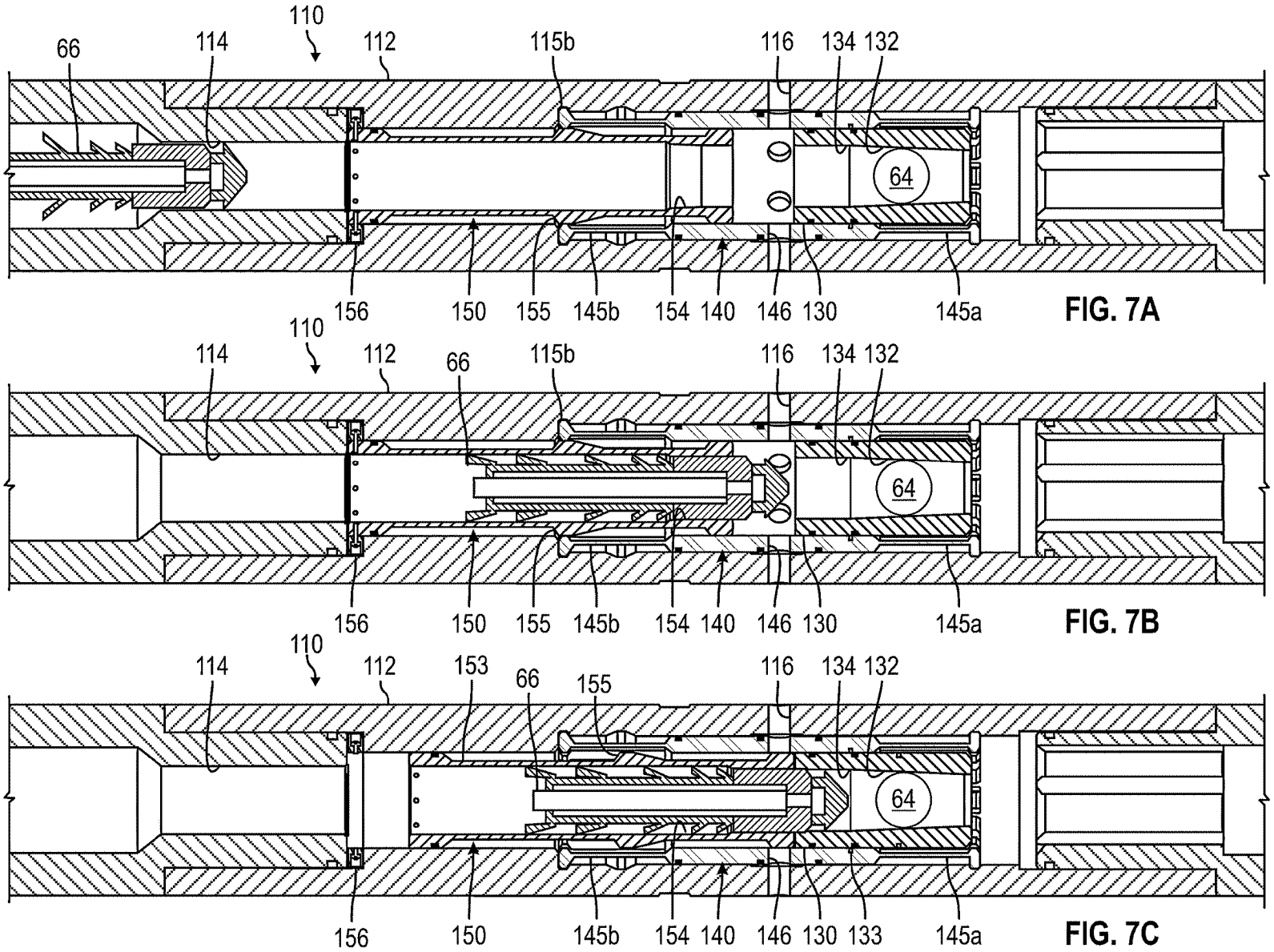
FIGS. 7A-7D illustrate cross-sections of the top-down cementing assembly during closing stages of operation.
Figure 7D:
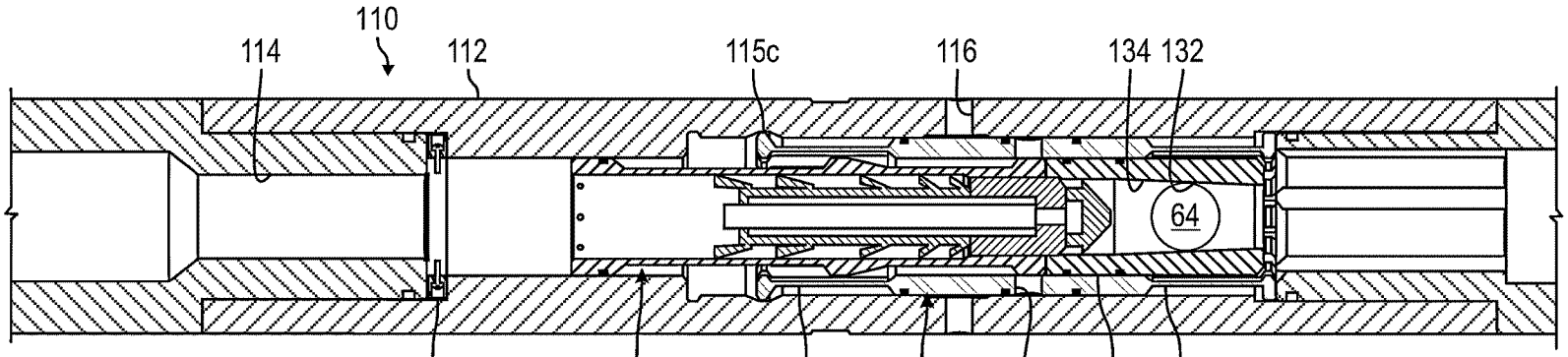

In particular, once cementing is done, the closing plug 66, such as a wiper dart shown in FIGS. 7A-7D, is pumped down the running tool (100) to engage the seat 154 of the closing sleeve 150. Pressure applied behind the seated wiper plug 66 eventually releases the sleeve's temporary connection 156 to the housing 112 so that the closing sleeve 150 shifts relative to the control sleeve 140. The external rim 155 shifts from the collet 145*b* of the control sleeve 140, leaving the collet 145*b* unsupported by an external under-cut section (153; FIG. 7C) in the closing sleeve 150. For example, pressure is applied to the wiper dart 66 on the seat 154 until the upper shear pins 156 shear and the closing seat 154 moves down allowing the upper collet 145*b* to collapse within the under-cut section 153 on the closing sleeve 150.

At this point, the closing sleeve 150, the control sleeve 140, and the opening sleeve 130 can shift as a unit in the housing's bore 114, as the fluid pressure overcomes the hold of the collets 145*a*-*b*. Once the upper collet 145*b* collapses, for example, the control sleeve 140 is allowed to shift downwards, and the flow ports 146 in the control sleeve 140 are no longer aligned with the bypass ports 116 in the housing 112. The bypass port 116 is then closed off, and the control sleeve 140 shoulders inside the bore 114. The lower collet 145*a* reaches a slot 115*a* in the bore 114, allowing the collet 145*a* to expand. Likewise, the upper collet 145*b* reaches another slot 115*c*, allowing the collet 145*b* to expand.

Figure 8:
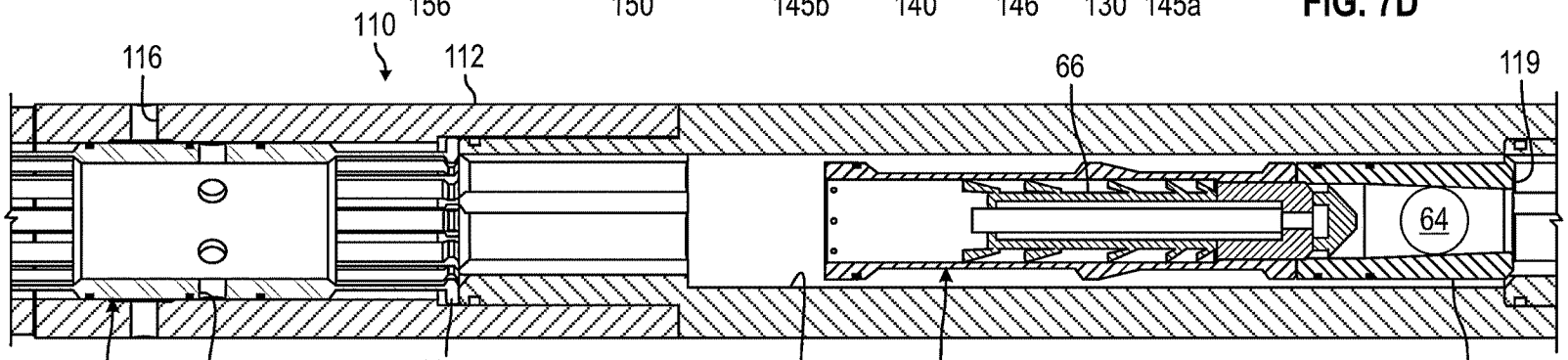
FIG. 8 illustrates a cross-section of the top-down cementing assembly during a final stage of operation.

As shown in FIG. 8, further pressure applied behind the wiper plug 64 can then force the opening sleeve 130 and closing sleeve 140 out of the shouldered control sleeve 140 and further to an expanded section 118 of the housing's bore 114 (or to some other landing profile downhole in the assembly 110). At the same time that the flow ports 116 are no longer aligned and the bypass ports 116 on the body are sealed off from the tubing pressure, the lower collets 145*a* of the inner sleeve 110 enter a recessed area 115*c* within the body 112 that allows the opening sleeve 130 and closing sleeve 150 to freely pass through the lower collets 145*a* and free fall down into the lower bypass area 118. The sleeves 130, 150 are then retained in the lower bypass area 118, which allows flow around the sleeves 130, 150 such that communication with the tubing string below the tool 100 can be re-established. In the present example, the opening sleeve 130 shoulders against a fluted shoulder 119 in the expanded section 118 of the housing's bore 114. Fluid communicated down the assembly 110 can pass around the unit of closing sleeve 150, dart 66, opening sleeve 130, and opening plug 64 and can pass through the flutes in the fluted shoulder 119 to communicate further down the running tool 100.

Figure 9:
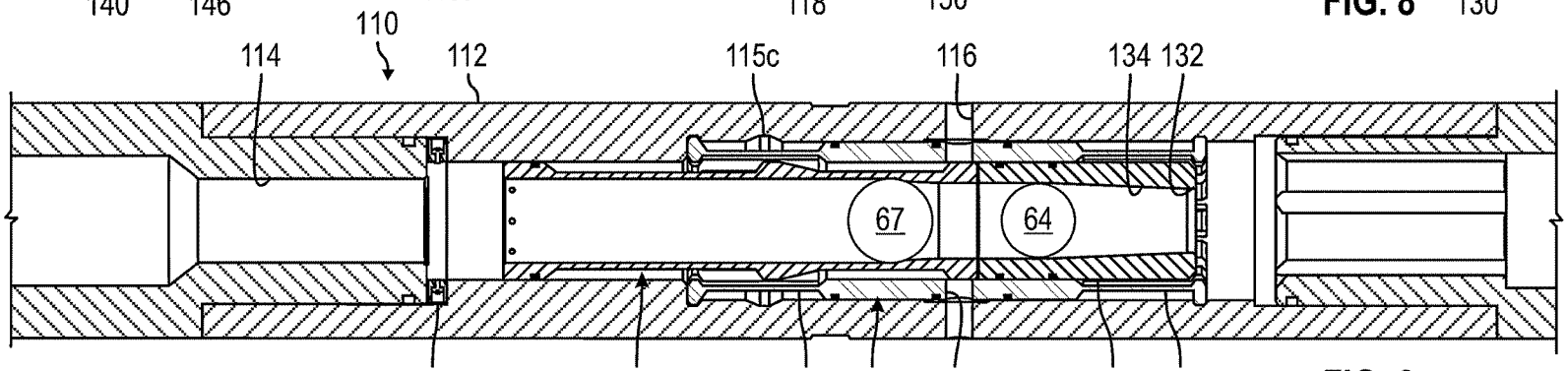
FIG. 9 illustrates a cross-section of an alternative configuration of a top-down cementing assembly for the running tool.

As an alternative, FIG. 9 illustrate a top-down cementing assembly 110 for the running tool in cross-section using an alternative closing plug in the form of a ball 67 of larger diameter. For this configuration, the overall operational sequence is almost identical. The only difference is that cement is displaced down to the assembly 110 without a wiper dart separating the cement from displacement fluid. Instead, once displacement is completed, a closing ball 67 is dropped from surface that lands on the closing seat 154 of the closing sleeve 150 and is used to close the top-down cementing assembly 110 in a similar manner to the dart discussed above.

Figure 10A:
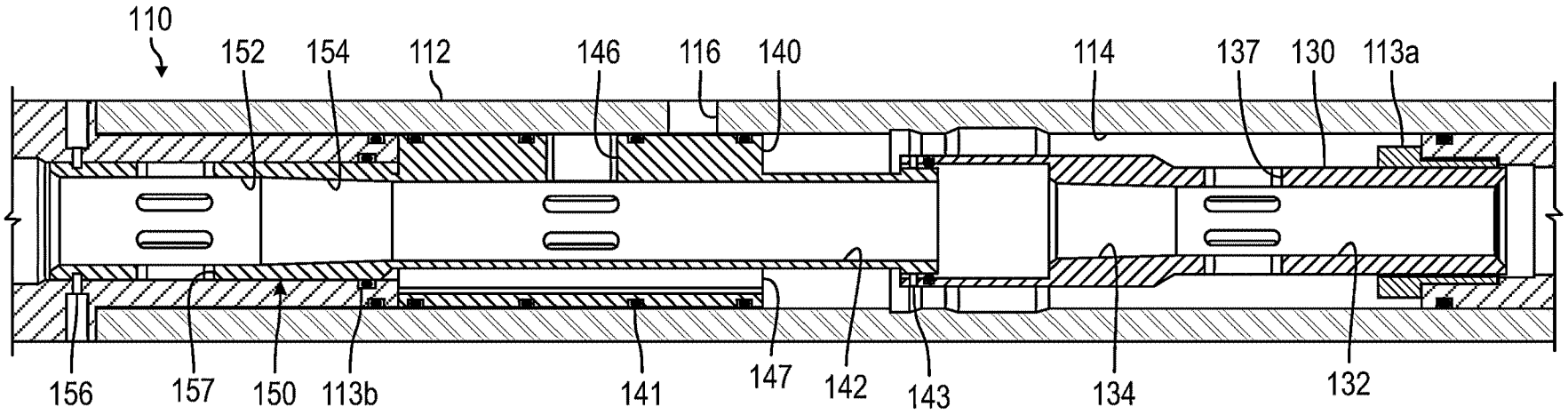
FIGS. 10A-10B illustrate cross-sections of another top-down cementing assembly for the running tool during initial stages of operation.
Figure 10B:
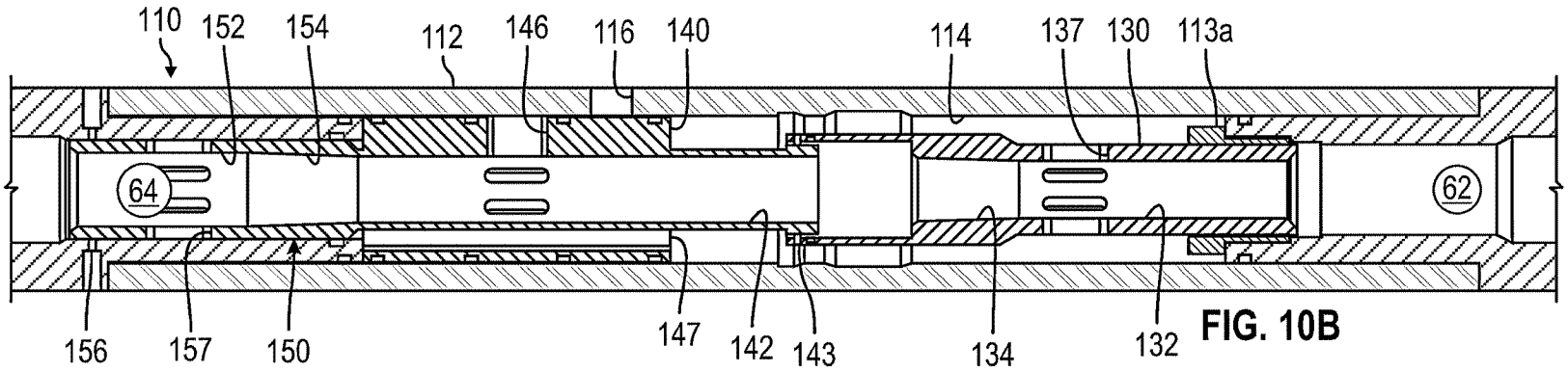

FIGS. 10A-10B illustrate cross-sections of another top-down cementing assembly 110 for the running tool. Similar reference numerals are used for components comparable to those discussed above. As shown, the cementing assembly 110 includes a housing 112, which can be comprised of one or more components. The housing 112 has a housing bore 114 passing therethrough (as part of the tool bore 105), and the bypass port 116 communicates with the housing bore 114.

A control sleeve 140 is movably disposed in the housing bore 114. The control sleeve 140 has a control port 146, which can be aligned or misaligned with the bypass port 116 with the movement of the control sleeve 140 in the housing bore 114. Seals 141 on the control sleeve 140 can seal inside the housing's bore 114.

An opening sleeve 130 is also disposed in the housing bore 114 and is connected to the control sleeve 140 by a temporary connection 143. The opening sleeve 130 has a seat 134 in the sleeve's bore 132, and the opening sleeve 130 is also movable in the housing bore 114. A seal 113*a* in the housing bore 114 can seal against the sleeve 130.

A closing sleeve 150 is part of, connected to, or engaged with the control sleeve 140. In the present example, the closing sleeve 150 and the control sleeve 140 form one unit, but this is not strictly necessary. The closing sleeve 150 has a seat 154 in the sleeve's bore 152, and the closing sleeve 150 is also movable in the housing bore 114. A seal 113*b* in the housing bore 114 can seal against the sleeve 150.

The top-down cementing assembly 110 is shown in FIGS. 10A-10B with the opening sleeve 130, the control sleeve 140, and the closing sleeve 150 in their run-in positions. The control sleeve 140 is in an closed position with the control port 146 misaligned with the tool's bypass port 116, preventing fluid communication through the control and bypass ports 146, 116. External seals 141 on the control sleeve 140 can seal inside the housing's bore 114 to seal off the bypass port 116. Meanwhile, the opening sleeve 130 disposed in the bore 114 is in an upper position. Ports 137 in the opening sleeve 130 can communicate with an enclosed plenum of the bore 114. However, this fluid in the enclosed plenum of the bore 114 does not communicate through the bypass port 116 due to the seals 141 and does not communication further downhole through the tool due to seal 113*a*. A temporary connection 143, such as shear pin or the like can be used between the opening sleeve 130 and the control sleeve 140 to hold the sleeves 130, 140 together until released, as discussed below.

The closing sleeve 150 is held in an initial condition in the housing's bore 114, and ports 157 in the closing sleeve 150 are sealed off by the seal 113*b* in the housing bore 114. A temporary connection 156, such as shear pins, can hold the closing sleeve 150 in place (and by extension the control sleeve 140 and the opening sleeve 130 can be held in place.

As noted above, operations begin by deploying the setting plug 62 down the running tool (100). As shown in FIGS.

10B, the setting plug 62 is sized to pass through the seat 134 of the opening sleeve 130 and the seat 154 of the closing sleeve 150. Once the setting steps are complete as noted above, the running tool (100) can remain in place in the liner hanger system (30) so the bypass port 116 can communicate with the liner lap for top-down cementing. As shown in FIG. 10B, the opening plug 64 is then deployed down the running tool (100).

Figure 11A:
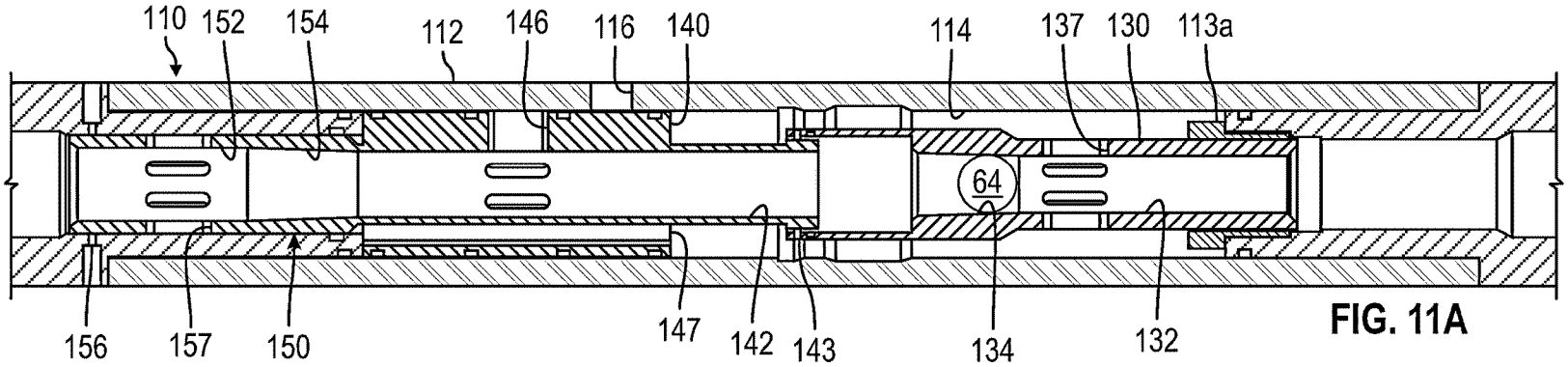
FIGS. 11A-11B illustrate cross-sections of the top-down cementing assembly during opening stages of operation.
Figure 11B:
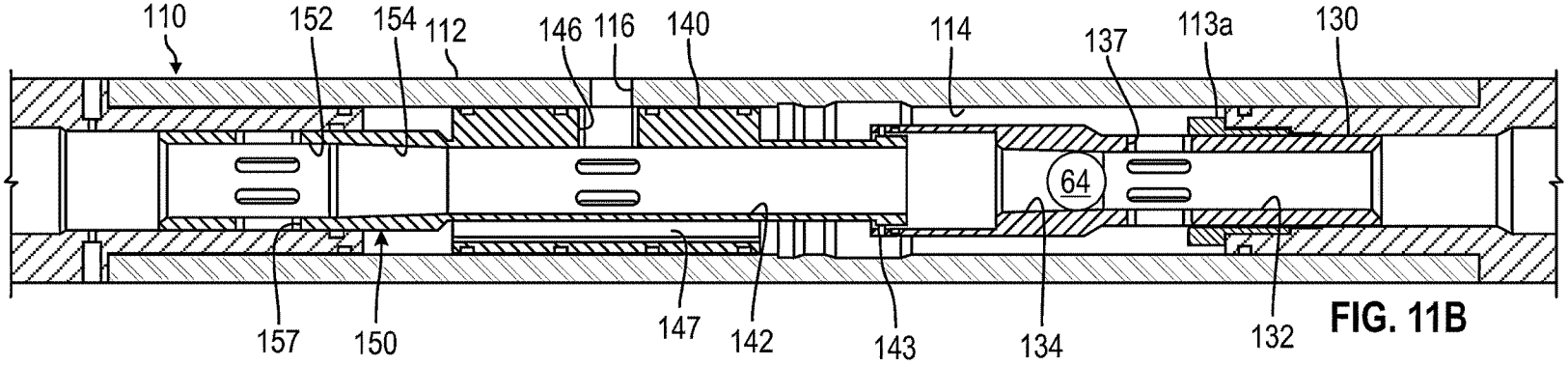

As shown in FIGS. 11A-11B, the opening plug 64 seats in the seat 134 of the opening sleeve 130, and hydraulic pressure communicated through the bore 114 shifts the opening sleeve 130, the control sleeve 140, and the closing sleeve 150 together. The control ports 146 on the control sleeve 140 are moved open relative to the bypass ports 116. The opening sleeve 130 is eventually caught by a lower catch (e.g., snap ring) engaged in the slot 115*d* of the housing bore 114. Movement of the control sleeve 140 to the opened condition relative to the control port 146 allows for fluid communication from the housing's bore 114, through the control port 146, and out the aligned bypass port 116 to commence cementing operation as discussed herein. Fluid communication can now be diverted out of the control and bypass ports 146 and 116 so the cement can communicate with the liner lap for top-down cementing.

Meanwhile, flow through the ports 137 in the opening sleeve 130 is still closed off, and the ports 157 on the closing sleeve 150 are still sealed off. Also, the control sleeve 140 is still engaged with the opening sleeve 130 through the temporary connection 143, which is configured to release when activated. To end cementing operations as discussed below, the control sleeve 140 is releasable in the housing's bore 114 to move the control port 146 closed relative to the bypass port 116. Ultimately, fluid communication through the running tool's bore can be reestablished so further completion operations can be performed as also discussed below.

Figure 12A:
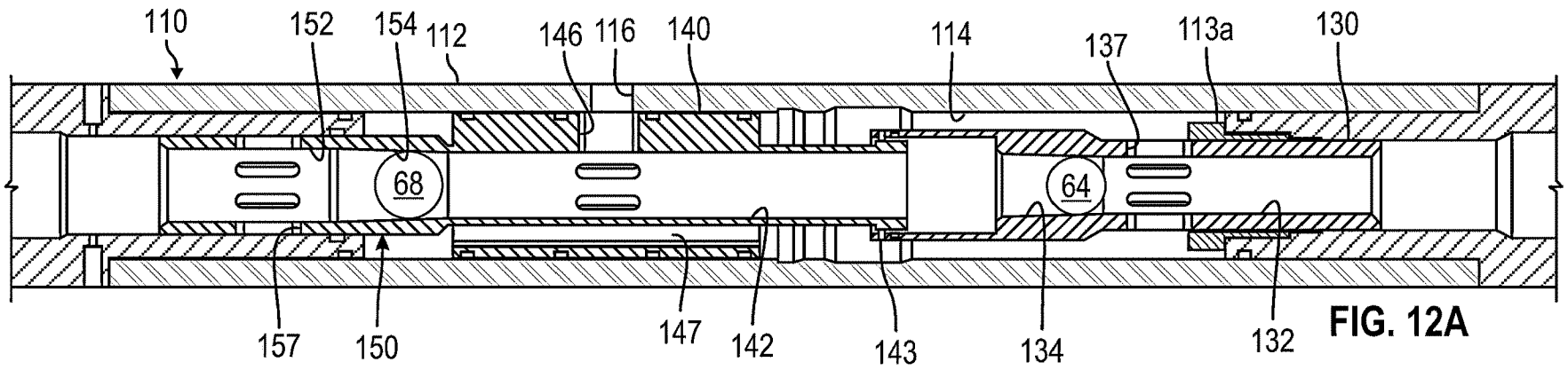
FIGS. 12A-12B illustrate cross-sections of the top-down cementing assembly during closing stages of operation.
Figure 12B:
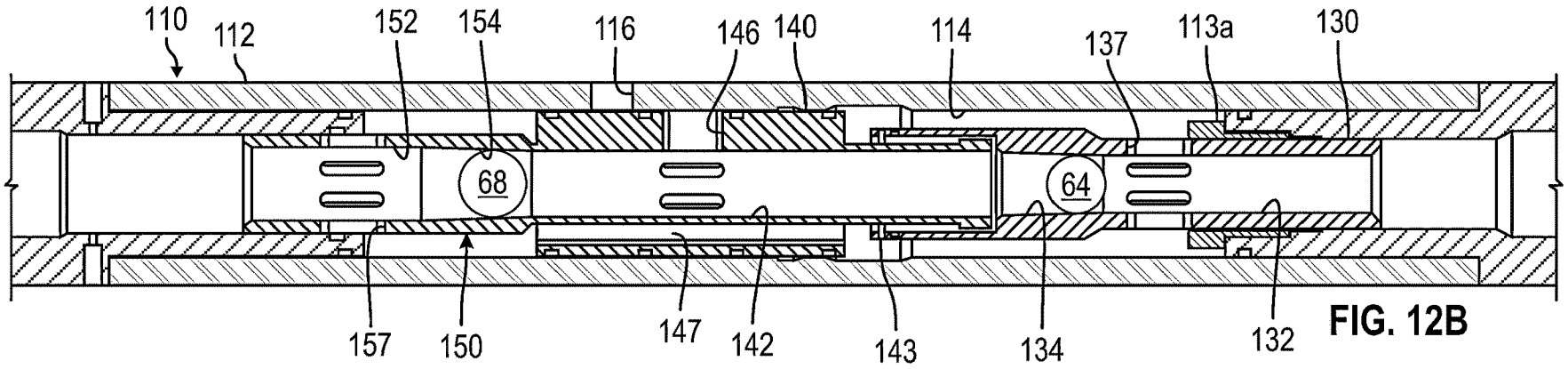

In particular, once cementing is done, the closing plug 68, such as a ball shown in FIGS. 12A-12B, is pumped down the running tool (100) to engage the seat 154 of the closing sleeve 150. Pressure applied behind the seated plug 68 eventually releases the control sleeve's temporary connection 143 to the opening sleeve so that the closing sleeve 150 and the control sleeve 140 shift as a unit in the housing bore 114. The end of the control sleeve 140 eventually shoulders in the end of the opening sleeve 130.

Once the control sleeve 140 is shifted downwards, the flow ports 146 in the control sleeve 140 are no longer aligned with the bypass ports 116 in the housing 112 so the bypass port 116 is then closed off. Movement of the closing sleeve 150 can then be locked using a catch (e.g., snap ring) in a slot 115*e* in the housing's bore 114.

However, as shown in FIG. 12B, fluid communicated down the assembly 110 can pass out of the ports 157 in the closing sleeve 150, into the plenum, through a bypass 147 in the control sleeve 140, from the plenum back through the ports 137 in the opening sleeve 130. Fluid can thereby be communicated further down the running tool.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A running tool for setting and cementing a liner assembly in a borehole using a plurality of plugs and cementation, the liner assembly having a liner bore, the running tool comprising:

a tool body having a tool bore extending therethrough;

a bypass section of the of the tool body defining a bypass port for the cementation, the bypass port communicating the tool bore outside the tool body, the bypass section at least including:

a control sleeve having a control port and being movable in the tool bore relative to the bypass port, an opening seat being configured to engage a first of the plugs and being movable in the tool bore, and a closing seat being configured to engage a second of the plugs and being movable in the tool bore, the bypass section in a closed condition being configured to prevent fluid communication from the tool bore out the bypass port, the bypass section in an opened condition being configured to open fluid communication from the tool bore out the bypass port in response to a first of the plugs engaged in the opening seat, the bypass section in a flow-through condition being configured to close fluid communication from the tool bore out the bypass port in response to a second of the plugs engaged in the closing seat and being configured to communicate flow through the tool bore past the first plug, the opening seat, the second plug, and the closing seat in the tool bore;

an isolation section of the tool body being configured to seal in the liner bore with the setting port in fluid communication with an actuator port in the liner bore of the liner assembly, the bypass section disposed uphole of the isolation section;

an engagement section of the of the tool body being configured to releasably engage the liner assembly; and a packoff seal disposed on the tool body between the engagement section and the bypass section and being configured to seal in the liner bore of the liner assembly.

2. The running tool of claim 1, wherein the opening seat in the closed condition for the bypass section lacks the first plug engaged therein and is configured to permit fluid communication in the tool bore through the opening seat to downhole of the tool body; and wherein the opening seat in the opened condition for the bypass section has the first plug engaged therein and is configured to prevent fluid communication in the tool bore through the opening seat.

3. The running tool of claim 1, comprising:

an opening sleeve having the opening seat therein and being releasably attached to the control sleeve, the opening sleeve being movable from a first position configured to prevent fluid communication through the control port to a second position configured to permit fluid communication through the control port; and a closing sleeve having the closing seat therein and being releasably attached to the tool body, the closing sleeve being movable from a third position to a fourth position, the closing sleeve in the third position being configured to prevent movement of the control sleeve in the tool bore, the closing sleeve in the fourth position being configured to permit movement of the control sleeve in the tool bore.

4. The running tool of claim 1, wherein the opening seat is disposed at least partially in the control sleeve and is movable in the control sleeve from a closed position to an opened position relative to the control port in response to the first plug engaged in the opening seat; wherein the closing seat is engaged with the control sleeve and is configured to release the control sleeve in response to the second plug; and wherein the control sleeve is releasable in the tool bore to move the control port from an opened position to a closed position relative to the bypass port.

5. The running tool of claim 4, comprising an opening sleeve disposed at least partially in the control sleeve and having the opening seat therein, the opening sleeve being movable in the control sleeve from the closed position to the opened condition relative to the control port in response to hydraulic pressure applied against the seated first plug, wherein the control sleeve comprises a catch being configured to catch the opening sleeve in the second closed position, the catch being configured to release the opening sleeve in response to a predetermined force.

6. The running tool of claim 4, comprising a closing sleeve disposed at least partially in the control sleeve and having the closing seat therein, the closing sleeve being movable, in response to hydraulic pressure applied against the seated second plug, from an engaged state to a disengaged state relative to a catch on the control sleeve, the catch being releasable by the closing sleeve in the disengaged state, the control sleeve being movable from the opened position to the closed position in response to the released catch.

7. The running tool of claim 6, wherein the catch on the control sleeve comprises a collet configured to engage in a groove of the tool bore; and wherein the closing sleeve comprises: a rim portion on the closing sleeve in the engaged state being configured to support the collet in the groove; and a recess portion on the closing sleeve in the disengaged state being configured to unsupport the collet in the groove; and/or wherein the closing sleeve comprises a temporary connection to the tool body, the temporary connection being releasable in response to a predetermined force from the hydraulic pressure applied against the seated second plug.

8. The running tool of claim 1, wherein the opening seat is connected to the control sleeve by a first temporary connection and is configured to move the control sleeve in the tool bore from a first position for the closed condition to a second position for the opened condition relative to the control port in response to the first plug engaged in the opening seat; wherein the control sleeve is releasable from the first temporary connection to move the control port from the second position for the opened condition to a third position for the flow-through condition relative to the bypass port; and wherein the closing seat is engaged with the control sleeve and is configured to release the first temporary connection of the control sleeve to the opening seat in response to the second plug.

9. The running tool of claim 8, comprising:

an opening sleeve having the opening seat therein, the opening sleeve having a first port downhole of the opening seat, the first port communicating the tool bore with the opening sleeve; and a closing sleeve having the closing seat therein, the closing sleeve having a second port uphole of the closing seat, the second port communicating the closing sleeve with the tool bore, the second port of the closing sleeve with the bypass section in the closed condition and in the opened condition being sealed from fluid communication with the first port of the opening sleeve.

10. The running tool of claim 9, wherein the control sleeve comprises a passage communicating a first portion the tool bore uphole of the control sleeve with a second portion of the tool bore downhole of the control sleeve, the passage of the control sleeve with the bypass section in the flow-through condition communicating the second port of the closing sleeve with the first port of the opening sleeve.

11. The running tool of claim 1, wherein the isolation section of the tool body defines a setting port communicating the tool bore outside the tool body, the isolation section comprising a setting seat being movable in the tool bore from a closed position to an opened position relative to the setting port in response to an initial one of the plugs.

12. A system for setting in a borehole using a running string, the borehole having a cased section, the system comprising:

a liner having a liner hanger, the liner hanger having a setting mechanism and a hydraulic actuator, the hydraulic actuator having an actuator port in a liner bore of the liner hanger, the hydraulic actuator being configured to set the setting mechanism in the cased section of the borehole; and a running tool being configured to connect to the running string and being at least partially insertable in the liner bore, the running tool comprising:

a tool body having a tool bore extending therethrough; and a bypass section of the of the tool body defining a bypass port for the cementation, the bypass port communicating the tool bore outside the tool body, the bypass section at least including:

a control sleeve having a control port and being movable in the tool bore relative to the bypass port, an opening seat being configured to engage a first of the plugs and being movable in the tool bore, and a closing seat being configured to engage a second of the plugs and being movable in the tool bore, the bypass section in a closed condition being configured to prevent fluid communication from the tool bore out the bypass port, the bypass section in an opened condition being configured to open fluid communication from the tool bore out the bypass port in response to a first of the plugs engaged in the opening seat, the bypass section in a flow-through condition being configured to close fluid communication from the tool bore out the bypass port in response to a second of the plugs engaged in the closing seat and being configured to communicate flow through the tool bore past the first plug, the opening seat, the second plug, and the closing seat in the tool bore.

13. The system of claim 12, wherein the liner comprises a float shoe disposed in the borehole toward a distal end of the liner; and/or wherein the system further comprises: a liner top packer connected uphole of the liner hanger, the liner top packer being configured to set by compression in the cased section of the borehole; and a polished bore receptacle connected to the liner top packer, the running tool having a packoff being configured to seal in the polished bore receptacle.

14. The system of claim 12, wherein the opening seat in the closed condition for the bypass section lacks the first plug engaged therein and is configured to permit fluid communication in the tool bore through the opening seat to downhole of the tool body; and wherein the opening seat in the opened condition for the bypass section has the first plug engaged therein and is configured to prevent fluid communication in the tool bore through the opening seat.

15. The system of claim 12, comprising:

an opening sleeve having the opening seat therein and being releasably attached to the control sleeve, the opening sleeve being movable from a first position configured to prevent fluid communication through the control port to a second position configured to permit fluid communication through the control port; and a closing sleeve having the closing seat therein and being releasably attached to the tool body, the closing sleeve being movable from a third position to a fourth position, the closing sleeve in the third position being configured to prevent movement of the control sleeve in the tool bore, the closing sleeve in the fourth position being configured to permit movement of the control sleeve in the tool bore.

16. The system of claim 12, wherein the opening seat is disposed at least partially in the control sleeve and is movable in the control sleeve from a closed position to an opened position relative to the control port in response to the first plug engaged in the opening seat; wherein the closing seat is engaged with the control sleeve and is configured to release the control sleeve in response to the second plug; and wherein the control sleeve is releasable in the tool bore to move the control port from an opened position to a closed position relative to the bypass port.

17. The system of claim 16, comprising an opening sleeve disposed at least partially in the control sleeve and having the opening seat therein, the opening sleeve being movable in the control sleeve from the closed position to the opened condition relative to the control port in response to hydraulic pressure applied against the seated first plug, wherein the control sleeve comprises a catch being configured to catch the opening sleeve in the second closed position, the catch being configured to release the opening sleeve in response to a predetermined force.

18. The system of claim 16, comprising a closing sleeve disposed at least partially in the control sleeve and having the closing seat therein, the closing sleeve being movable, in response to hydraulic pressure applied against the seated second plug, from an engaged state to a disengaged state relative to a catch on the control sleeve, the catch being releasable by the closing sleeve in the disengaged state, the control sleeve being movable from the opened position to the closed position in response to the released catch.

19. The system of claim 18, wherein the catch on the control sleeve comprises a collet configured to engage in a groove of the tool bore, the closing sleeve comprising: a rim portion on the closing sleeve in the engaged state being configured to support the collet in the groove; and a recess portion on the closing sleeve in the disengaged state being configured to unsupport the collet in the groove; and/or wherein the closing sleeve comprises a temporary connection to the tool body, the temporary connection being releasable in response to a predetermined force from the hydraulic pressure applied against the seated second plug.

20. The system of claim 12, wherein the opening seat is connected to the control sleeve by a first temporary connection and is configured to move the control sleeve in the tool bore from a first position for the closed condition to a second position for the opened condition relative to the control port in response to the first plug engaged in the opening seat; wherein the control sleeve is releasable from the first temporary connection to move the control port from the second position for the opened condition to a third position for the flow-through condition relative to the bypass port; and wherein the closing seat is engaged with the control sleeve and is configured to release the first temporary connection of the control sleeve to the opening seat in response to the second plug.

21. The system of claim 20, comprising:

an opening sleeve having the opening seat therein, the opening sleeve having a first port downhole of the opening seat, the first port communicating the tool bore with the opening sleeve; and a closing sleeve having the closing seat therein, the closing sleeve having a second port uphole of the closing seat, the second port communicating the closing sleeve with the tool bore, the second port of the closing sleeve with the bypass section in the closed condition and in the opened condition being sealed from fluid communication with the first port of the opening sleeve.

22. The system of claim 21, wherein the control sleeve comprises a passage communicating a first portion the tool bore uphole of the control sleeve with a second portion of the tool bore downhole of the control sleeve, the passage of the control sleeve with the bypass section in the flow-through condition communicating the second port of the closing sleeve with the first port of the opening sleeve.

23. The system of claim 12, further comprising:

an isolation section of the tool body being configured to seal in the liner bore with the setting port in fluid communication with an actuator port in the liner bore of the liner assembly, the bypass section disposed uphole of the isolation section, the isolation section of the tool body defining a setting port communicating the tool bore outside the tool body, the isolation section comprising a setting seat being movable in the tool bore from a closed position to an opened position relative to the setting port in response to an initial one of the plugs;

an engagement section of the of the tool body being configured to releasably engage the liner assembly; and a packoff seal disposed on the tool body between the engagement section and the bypass section and being configured to seal in the liner bore of the liner assembly.

24. A method of lining a borehole with a liner, the borehole having a cased section, the method comprising:

running the liner in the borehole using a running tool on a running string;

setting a liner hanger on the liner in the cased section using hydraulic pressure from the running string;

opening a bypass port on the running tool uphole of a packoff of the running tool in the liner hanger by seating an opening plug in an opening seat in the running tool, using hydraulic pressure from the running string behind the opening plug seated in the opening seat in the running tool, and shifting the opening seat open relative to a bypass port in the running tool;

bullheading cement into a lap of the liner and the borehole through the bypass port;

closing the bypass port on the running tool by seating a closing plug in a closing seat in the running tool, using hydraulic pressure from the running string behind the closing plug seated in the running tool to shift the closing seat and release a control sleeve in the running tool, and closing the control sleeve relative to the bypass port; and reestablishing fluid communication from the running string to the liner through the running tool past the opening and closing plugs by catching the opening seat, the opening plug, the closing seat, and the closing plug in a section of the running tool and permitting the fluid communication through the section.

* * * * *